US010775723B2

(12) United States Patent
Lee et al.

(10) Patent No.: US 10,775,723 B2
(45) Date of Patent: Sep. 15, 2020

(54) FUSING DEVICE WITH LUBRICANT SUPPLYING UNIT AND IMAGE FORMING APPARATUS HAVING THE SAME

(71) Applicant: HEWLETT-PACKARD DEVELOPMENT COMPANY, L.P., Spring, TX (US)

(72) Inventors: Seung-Jun Lee, Suwon-si (KR); Dong-kyun Kim, Suwon-si (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/295,532

(22) Filed: Mar. 7, 2019

(65) Prior Publication Data

US 2019/0204766 A1 Jul. 4, 2019

Related U.S. Application Data

(63) Continuation of application No. PCT/KR2017/006292, filed on Jun. 16, 2017.

(30) Foreign Application Priority Data

Sep. 12, 2016 (KR) ..... 10-2016-0117095

(51) Int. Cl.
*G03G 15/20* (2006.01)

(52) U.S. Cl.
CPC ..... *G03G 15/2025* (2013.01); *G03G 15/2064* (2013.01); *G03G 2215/2038* (2013.01); *G03G 2215/2093* (2013.01)

(58) Field of Classification Search
USPC ..... 399/329
See application file for complete search history.

(56) References Cited

U.S. PATENT DOCUMENTS

2005/0147436 A1 7/2005 Koyama et al.
2008/0219726 A1* 9/2008 Fukai ..... G03G 15/206 399/329

(Continued)

FOREIGN PATENT DOCUMENTS

JP 2011-081303 4/2011
KR 10-0703006 3/2007

(Continued)

*Primary Examiner* — Quana Grainger
(74) *Attorney, Agent, or Firm* — Staas & Halsey LLP

(57) ABSTRACT

A fusing device of which a lifespan may be increased by stably supplying a lubricant to a fusing belt, and an image forming apparatus including the same are provided. The fusing device includes: a fusing roller configured to be rotatable; a fusing belt configured to be circumscribed to the fusing roller to be driven and rotated by the fusing roller; a nip forming member configured to be inscribed to the fusing belt to form a nip at a contact portion of the fusing roller; a lubricant supplying unit configured to include a lubricant accommodating portion provided at one side of the nip forming member and storing a lubricant and an impregnating member impregnating the lubricant from the lubricant accommodating portion and supplying the lubricant to an inner surface of the fusing belt; and a fixing member configured to be fixedly installed between the impregnating member and the nip forming member to prevent the impregnating member from being separated from the nip forming member due to the rotation of the fusing belt.

19 Claims, 14 Drawing Sheets

(56) References Cited

U.S. PATENT DOCUMENTS

| | | | | |
|---|---|---|---|---|
| 2012/0076556 | A1* | 3/2012 | Komuro | G03G 15/2025 399/329 |
| 2015/0227096 | A1* | 8/2015 | Nemoto | G03G 15/2053 399/329 |
| 2017/0219973 | A1* | 8/2017 | Hadano | G03G 15/2025 |
| 2017/0364006 | A1* | 12/2017 | Minemura | G03G 15/2053 |
| 2018/0067432 | A1* | 3/2018 | Yamaguchi | G03G 15/2053 |
| 2018/0081310 | A1* | 3/2018 | Tsubotani | G03G 15/2025 |

FOREIGN PATENT DOCUMENTS

| | | |
|---|---|---|
| KR | 10-2012-0071021 | 7/2012 |
| KR | 10-2015-0083731 | 7/2015 |

* cited by examiner

FUSING DEVICE WITH LUBRICANT SUPPLYING UNIT AND IMAGE FORMING APPARATUS HAVING THE SAME

CROSS-REFERENCE TO RELATED APPLICATION(S)

This application is a continuation application of PCT international patent application no. PCT/KR2017/006292, filed on Jun. 16, 2017, which is based on and claims priority under 35 U.S.C. § 119 to Korean Patent Application No. 10-2016-0117095, filed on Sep. 12, 2016, in the Korean Intellectual Property Office, the disclosure of which is incorporated by reference herein in its entirety.

BACKGROUND OF THE INVENTION

Field of the Invention

Apparatuses consistent with the disclosure relate to a fusing device of which a lifespan may be increased by stably supplying a lubricant to a fusing belt, and an image forming apparatus including the same.

Description of the Related Art

Generally, an image forming apparatus that uses an electrophotographic manner supplies a toner to an electrostatic latent image formed on a photoreceptor to form a visible toner image on the photoreceptor, transfers the visible toner image to a recording medium, and then fuses the transferred toner image on the recording medium to print the image on the recording medium.

To fuse the transferred toner image on the recording medium in a process of printing the image on the recording medium as described above, the image forming apparatus includes a fusing device heating and pressing the recording medium to which the toner image is transferred.

The fusing device includes a pressing roller pressing the recording medium and a fusing belt heating the recording medium while rotating in a state of being circumscribed to the heating roller. A nip forming member forming a fusing nip is disposed at a contact portion between the pressing roller and the fusing belt on an inner surface of the fusing belt.

Such a fusing device has a structure in which the fusing belt rotates with respect to the nip forming member, and friction is thus generated at a contact portion between the fusing belt and the nip forming member. A speed difference between the fusing belt and the pressing roller may be generated due to the friction, and a torque of a predetermined magnitude or more may be applied to the pressing roller.

Therefore, a slip phenomenon in which a non-fused toner image slips on the recording medium may occur, and there is a risk that the fusing belt may be damaged due to abrasion of the nip forming member or the fusing belt caused by the friction. To prevent the slip phenomenon or the damage to the fusing belt, a lubricant is applied between the fusing belt and the nip forming member to reduce the friction between the fusing belt and the nip forming member.

It is preferable that the lubricant stays for a long period of time between the fusing belt and the nip forming member for the purpose of stable fusion. However, as the fusing belt rotates, the lubricant applied between the nip forming member and the fusing belt may be leaked out. In this case, a similar result may be ensued even though a large amount of lubricant is applied between the nip forming member and the fusing belt at a time.

BRIEF DESCRIPTION OF THE DRAWING FIGURES

The above and/or other aspects of the present disclosure will be more apparent by describing certain exemplary embodiments of the present disclosure with reference to the accompanying drawings, in which.

DETAILED DESCRIPTION OF THE EXEMPLARY EMBODIMENTS

Figure 1:
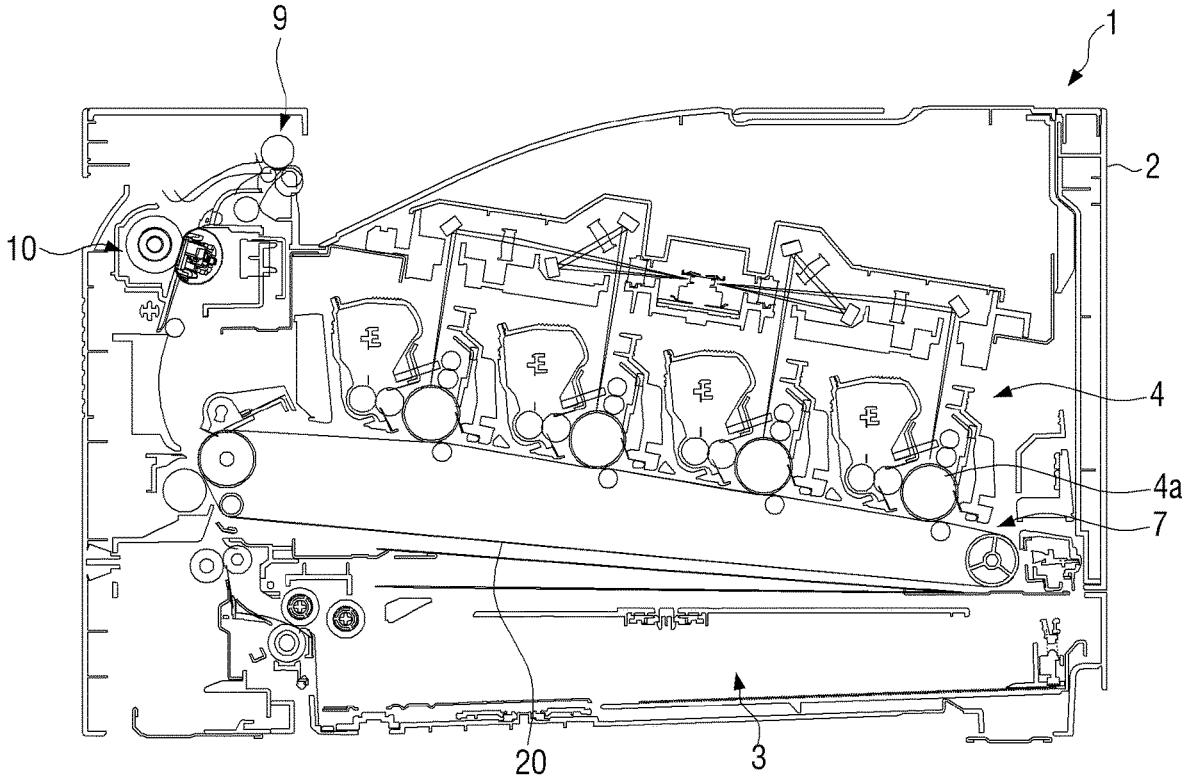
FIG. 1 is a cross-sectional view schematically illustrating a configuration of an image forming apparatus according to an embodiment of the disclosure.

Hereinafter, embodiments of the disclosure will be described in more details with reference to FIGS. 1 through 13. Embodiments to be described below will be described on the basis of embodiments most appropriate for understanding technical features of the disclosure, and these embodiments do not limit the technical features of the disclosure, but exemplify that the disclosure may be implemented like these embodiments.

Therefore, the disclosure may be variously modified without departing from the technical scope of the disclosure through embodiments to be described below, and these modifications will fall within the technical scope of the disclosure. In addition, to assist in the understanding of embodiments to be described below, related components among components performing the same operations in the respective embodiments will be denoted by the same or similar reference numerals throughout the accompanying drawings.

FIG. 1 is a cross-sectional view schematically illustrating a configuration of an image forming apparatus according to an embodiment of the disclosure. Referring to FIG. 1, the image forming apparatus includes a body 2, a recording medium supplying unit 3, a plurality of photoreceptors 4*a*, a developing unit 4, a transfer unit 7, a fusing device 10, a recording medium discharging unit 9, and a light irradiating unit (not illustrated).

The body 2 forms an appearance of the image forming apparatus 1, and supports various components installed in the image forming apparatus 1. A portion of the body 2 is provided to be openable or closable. A user may replace or repair various components through the opened portion or remove a recording medium jammed inside the body 2.

The recording medium supplying unit 3 supplies recording media toward the transfer unit 7. As an example, the recording medium supplying unit 3 includes a cassette in which recording media S are stored, a pick-up roller picking up the recording media stored in the cassette one by one, and transport rollers transporting the picked-up recording media to the transfer unit 7.

The light irradiating unit irradiates light corresponding to image information to the photoreceptors 4*a* to form electrostatic latent images on surfaces of the photoreceptors 4*a*. Although not illustrated in the drawings, the light irradiating unit may include a light source emitting a light beam, a deflecting device deflecting the emitted light beam through a polygon mirror rotating by a motor, and an F-theta lens converging the deflected light beam on the photoreceptors.

The developing unit 4 supplies toners, which are developers, to the electrostatic latent images formed on the photoreceptors 4*a* to form visible toner images. The developing unit 4 includes four developing machines with developers having different colors, for example, the developers having black (K), cyan (C), magenta (M), and yellow (Y) are accommodated, respectively.

Each of the developing machines has a charger, a developer storing portion, a developer transporting member, and a developing member. The respective chargers charge the surfaces of the photoreceptors 4*a* before the electrostatic latent images are formed on the photoreceptors 4*a*. The developers stored in the developer storing portions are transported toward the developing members by the developer transporting members, and the developing members supply the developers to the electrostatic latent images formed on the photoreceptors 4*a* to form visible images.

An example in which four photoreceptors 4*a* are included in the respective developing machines has been illustrated, but the image forming apparatus 1 according to the embodiment of the disclosure may also be configured so that four developing machines form a visible image on one photoreceptor.

The transfer unit 7 receives the visible images formed on the photoreceptors 4*a* and transfers the visible images to the recording medium S. The transfer unit 7 includes a transfer belt, a driving roller, a support roller, tension rollers, and transfer rollers.

The transfer belt is rotatably supported by the driving roller and support roller. The driving roller rotates by receiving a driving force delivered from a driving source (not illustrated) mounted in the body. The support roller is disposed on an opposite side to the driving roller to support an inner surface of the transfer belt.

An outer circumferential surface of the transfer belt faces the respective photoreceptors 4*a*. The transfer rollers are disposed to correspond to the respective photoreceptors 4*a*, and support an inner peripheral surface of the transfer belt.

When the image forming apparatus 1 performs a color printing operation, the transfer rollers are pressed toward the respective photoreceptors 4*a*. In this case, the respective visible images formed on the photoreceptors 4*a* are transferred to and overlapped with one another on the transfer belt by the transfer rollers, and an image of the transfer belt is transferred to the recording medium S supplied from the recording medium supplying unit 3 and then passing between the transfer rollers and the transfer belt.

The recording medium passing through the transfer unit 7 enters the fusing device 10. The fusing device 10 is configured to apply heat and pressure to the recording medium to fix a non-fused toner image on the recording medium to the recording medium.

The recording medium passing through the fusing device 10 is guided to the recording medium discharging unit 9, and the recording medium discharging unit 9 discharges the recording medium from the image forming apparatus 1. The recording medium discharging unit 9 includes a discharging roller and a discharging back-up roller installed to face the discharging roller. Hereinafter, the fusing device 10 included in the image forming apparatus 1 according to the embodiment of the disclosure will be described in detail.

Figure 2:
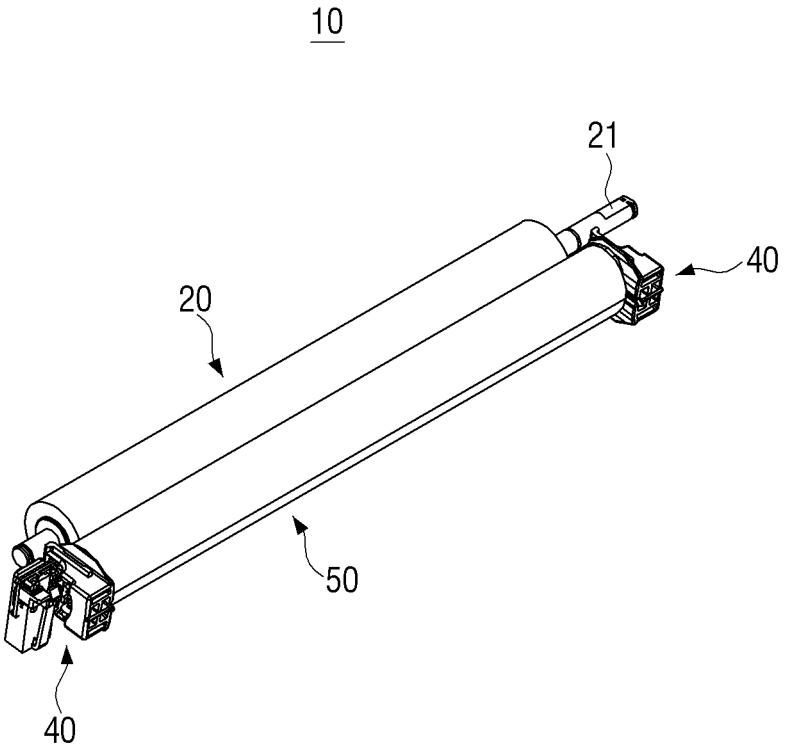
FIG. 2 is a perspective view illustrating a fusing device according to an embodiment of the disclosure.
Figure 3:
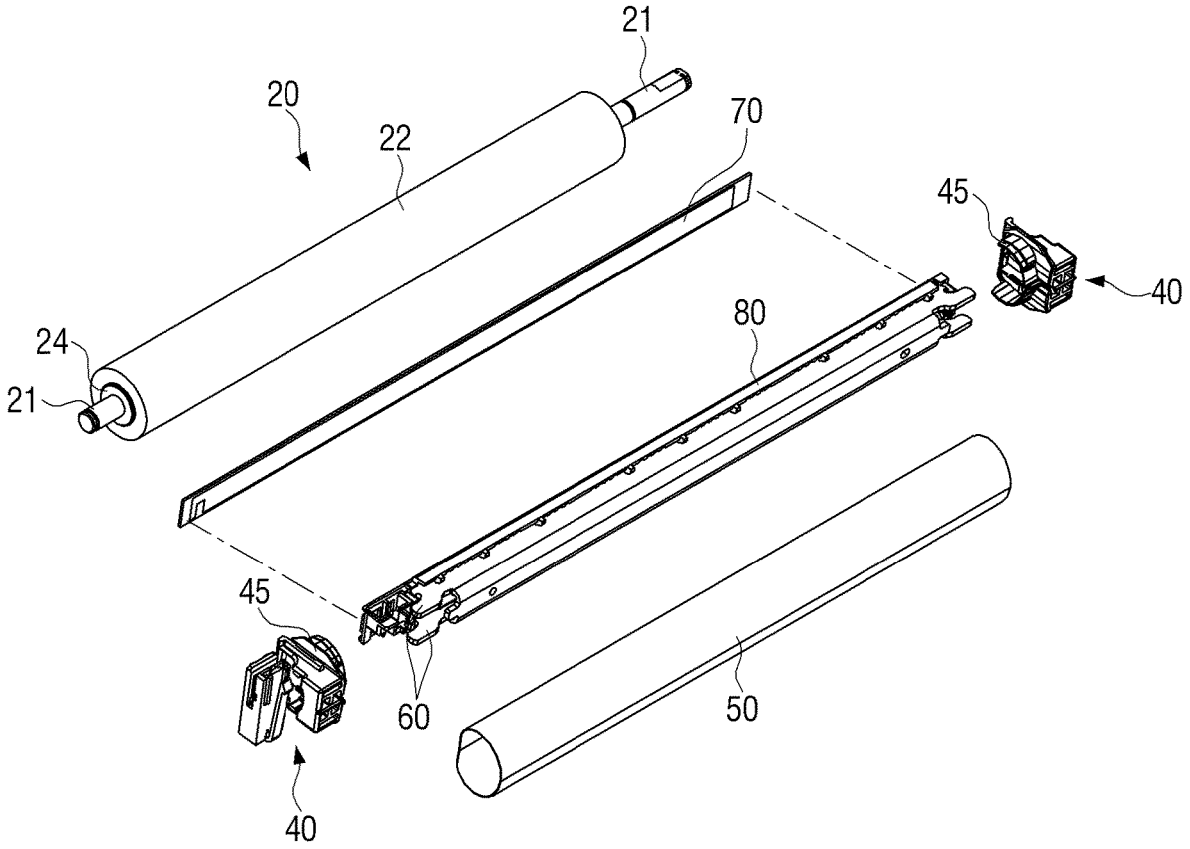
FIG. 3 is an exploded perspective view illustrating the fusing device according to the embodiment of the disclosure.
Figure 4:
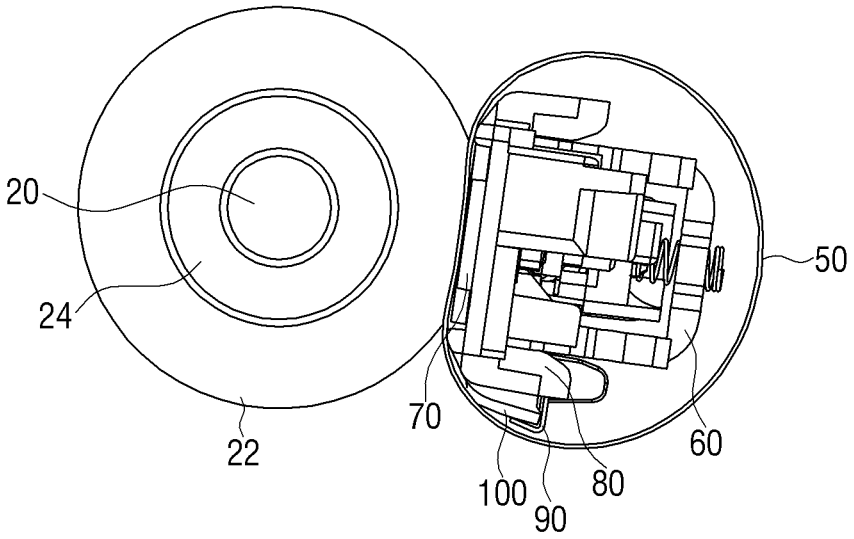
FIG. 4 is a side view illustrating the fusing device according to the embodiment of the disclosure.
Figure 5:
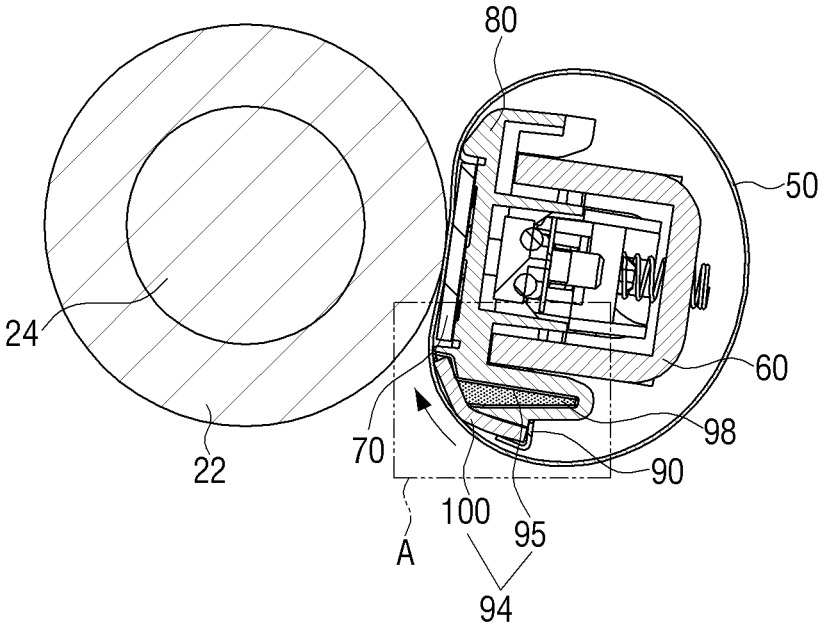
FIG. 5 is a cross-sectional view illustrating the fusing device according to the embodiment of the disclosure.
Figure 6:
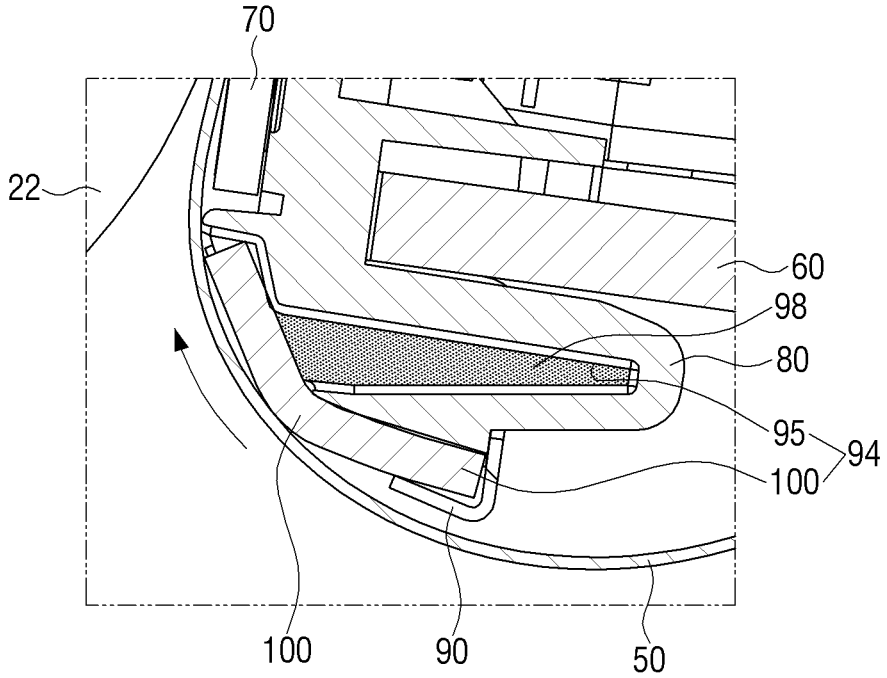
FIG. 6 is an enlarged view of part A illustrated in FIG. 5.
Figure 7:
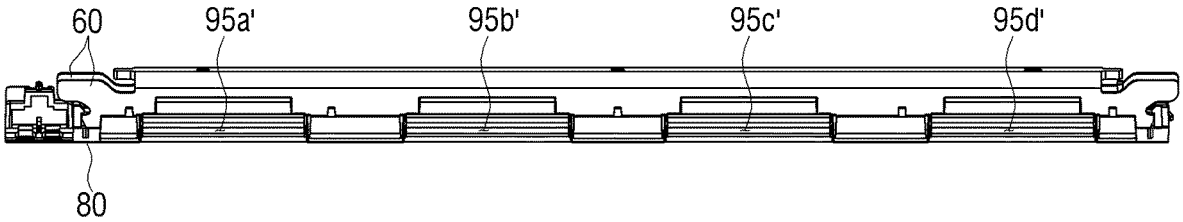
FIG. 7 is a view for describing a position of a lubricant supplying unit according to the embodiment of the disclosure.

FIG. 2 is a perspective view illustrating a fusing device according to an embodiment of the disclosure, and FIG. 3 is an exploded perspective view illustrating the fusing device according to the embodiment of the disclosure. In addition, FIG. 4 is a side view illustrating the fusing device according to the embodiment of the disclosure, and FIG. 5 is a cross-sectional view illustrating the fusing device according to the embodiment of the disclosure. In addition, FIG. 6 is an enlarged view of part A illustrated in FIG. 5, and FIG. 7 is a view for describing a position of a lubricant supplying position according to the embodiment of the disclosure.

Referring to FIGS. 2 to 7, the fusing device 10 includes a fusing roller 20 and a nip forming member 80 which are disposed to face each other to form a fusing nip N through which the recording medium passes, a fusing belt 50 circumscribed to the fusing roller 20 to be driven and rotated by the fusing roller 20, a heater 70 heating the fusing belt 50, a lubricant supplying unit 94 supplying a lubricant 98 to an inner surface of the fusing belt 50, and a fixing member 90 fixing an impregnating member 100 provided in the lubricant supplying unit 94 to the nip forming member 80.

The fusing roller 20, which is an example of a rotating roller that is rotatable, presses the recording medium passing through the fusing nip N. The fusing roller 20 rotates by receiving a driving force delivered through a driving source (not illustrated) mounted in the body 10 of the image forming apparatus 1. In a process in which the recording medium passes through the fusing nip N between the fusing roller 20 and the fusing belt 50, a toner image transferred to the recording medium S is fixed to the recording medium S by heat and pressure.

The fusing roller 20 includes a shaft 21 and an elastic layer 24. The shaft 21 is disposed at a central portion of the fusing roller 20, and functions as a rotating shaft. The shaft 21 may be formed of a metal material such as aluminum or steel. The elastic layer 24 is disposed to cover the surrounding of the shaft 21, and forms the fusing nip N between the elastic layer 24 and the fusing belt 50 while being elastically deformed at the time of pressure-contact between the fusing roller 20 and the fusing belt 50. The elastic layer 24 may be a heat-resistant elastomer layer. A heat-resistant elastomer may be, for example, a silicon elastomer, a fluoroelastomer, or the like. A release layer 22 preventing the recording medium S from being attached to the fusing roller 20 may be formed on a surface of the elastic layer 24. The release layer 22 may be formed of one of, for example, perfluoroalkoxy (PFA), polytetrafluoroethylenes (PTFE), fluorinated ethylene propylene (FEP), or the like, a blend of two or more thereof, or a copolymer thereof.

The heater 70, which is to provide the heat to the recording medium, may be installed on a bottom surface of the nip forming member 80. As an example, the heater 70 may be provided at a position corresponding to a contact portion forming the nip, be disposed to be in contact with the fusing belt 50, and heat the fusing belt 50.

Meanwhile, the heater 70 may be spaced apart from the fusing belt 50, and heat the fusing belt 50 by radiation heating. As an example of a heating source, a halogen lamp or an induction heating coil may be used. However, a position and a kind of heating source are not limited thereto. For example, the heating source may be disposed outside the fusing belt 50. Meanwhile, the heating source may be a component separate from the fusing belt 50, but may also be a heat generating layer included in the fusing belt 50.

The fusing belt 50 is circumscribed to the fusing roller 20, and is driven and rotated by the fusing roller 20. The fusing belt 50 may have an endless shape. However, a structure of the fusing belt 50 is not necessarily limited thereto, and may be a film shape having an end portion and a structure in which a film is wound by a pair of rollers.

The fusing belt 50 is heated by the heating source. The heated fusing belt 50 is in contact with the recording medium passing through the fusing nip N to heat the recording medium, thereby fixing the toner image transferred to the recording medium to the recording medium.

The fusing belt 50 may include a base layer, an elastic layer, and a release layer although not illustrated in the drawings. The base layer may include at least one of a plastic material, such as a heat-resistant resin, or the like, or a metal material. The heat-resistant resin may be polyimide, polyimideamide, polyetherether ketone, or the like, and the metal material may include nickel (Ni), stainless steel, copper (Cu), and alloys thereof, or the like. The elastic layer may be a heat-resistant elastomer layer. A heat-resistant elastomer may be, for example, a silicon elastomer, a fluoroelastomer, or the like.

The release layer may be formed of one of, for example, perfluoroalkoxy (PFA), polytetrafluoroethylenes (PTFE), fluorinated ethylene propylene (FEP), or the like, a blend of two or more thereof, or a copolymer thereof.

A thickness of the fusing belt 50 may be about 30 μm to 200 μm. Therefore, rapid temperature rise performance of the fusing belt may be secured.

The nip forming member 80 is in contact with the inner surface of the fusing belt 50 to support the fusing belt 50 pressed by the fusing roller 20. Therefore, the fusing nip N is formed between the fusing roller 20 and the fusing belt 50. The nip forming member 80 is coupled to and fixed and supported by a pressing member 60. The pressing member 60 may press the nip forming member 80, and a pressing force may be applied toward the nip forming member 80 by a spring as an example.

The nip forming member 80 is disposed to face the fusing roller 20 pressing an outer circumferential surface of the fusing belt 50. Therefore, the nip forming member 80 presses the inner surface of the fusing belt 50.

Because the nip forming member 80 is in a state in which it is fixed by the pressing member 60, when the fusing belt 50 rotates, a frictional force acts on a region in which the fusing belt 50 and the nip forming member 80 are in contact with each other. The frictional force may increase a torque acting on the fusing roller 20 or cause slip of the recording medium and the fusing belt 50 on the fusing nip. To prevent such a phenomenon, the lubricant 98 may be supplied between the fusing belt 50 and the nip forming member 80 to prevent direct contact between the fusing belt 50 and the nip forming member 80.

However, the lubricant 98 supplied between the fusing belt 50 and the nip forming member 80 tends to be easily leaked or disappear due to characteristics thereof. For example, the lubricant 98 may be leaked from a position between the fusing belt 50 and the nip forming member 80 at the time of rotation of the fusing belt 50 due to fluidity of the lubricant 98. In addition, because a high temperature and a high pressure are applied between the fusing belt 50 and the nip forming member 80 by the heater 70 and the fusing roller 20, the lubricant 98 supplied between the fusing belt 50 and the nip forming member 80 may be vaporized in such a high-temperature and high-pressure environment.

In the embodiment of the disclosure, for the fusing device 10, the lubricant 98 may be supplied between the fusing belt 50 and the nip forming member 80 for a long period of time even though the lubricant 98 supplied between the fusing belt 50 and the nip forming member 80 is leaked or disappears. To this end, the fusing device 10 according to the embodiment of the disclosure may further include the lubricant supplying unit 94 having a predetermined structure and the predetermined lubricant 98 used in the lubricant supplying unit 94. Hereinafter, the lubricant supplying unit 94 and the lubricant 98 according to the embodiment of the disclosure will be described in detail.

The lubricant supplying unit 94 is disposed in the fusing belt 50, and serves to supply the lubricant 98 between the fusing belt 50 and the nip forming member 80. As an example, the lubricant supplying unit 94 may supply the lubricant 98 to the inner surface of the fusing belt 50. The lubricant supplied to the inner surface of the fusing belt 50 may move between the nip forming member 80 and the fusing belt 50 as the fusing belt 50 rotates.

The lubricant supplying unit 94 includes a lubricant accommodating portion 95 provided at one side of the nip forming member 80 for storing the lubricant 98 and the impregnating member 100 for impregnating the lubricant 98 from the lubricant accommodating portion and supplying the lubricant 98 to the inner surface of the fusing belt 50.

The lubricant supplying unit 94 may be disposed at a rear of the nip forming member 80 in a rotation direction of the fusing belt 50. In addition, the lubricant supplying unit 94 may be provided at an upper side of the rear of the nip forming member 80 and supply the lubricant 98 at an upstream of the nip forming member 80 to minimize exposure of the lubricant 98 to the heater 70 and stably supply the lubricant 98 between the nip forming member 80 and the fusing belt 50.

However, a position of the lubricant supplying unit 94 is not limited to the upstream of the nip forming member 80, and may be appropriately changed if necessary.

The lubricant accommodating portion 95 includes a cavity or a space in which the lubricant 98 may be stored. An opening through which the lubricant 98 stored in the lubricant accommodating portion 95 may be discharged is formed at least one side of the lubricant accommodating portion 95.

A rear surface of the lubricant accommodating portion 95 may have an inclined shape. Such an inclined surface is installed to be inclined in a downward direction toward the opening. Here, the downward direction may be parallel with a direction of gravity. Therefore, the lubricant 98 accommodated in the lubricant accommodating portion 95 may be disposed through the opening along the rear surface by the gravity.

The lubricant accommodating portion 95 may be continuously formed in a lengthwise direction. A length of the lubricant accommodating portion 95 may correspond to a width of the recording medium. Here, the lengthwise direction may refer to a direction parallel with a width direction of the recording medium and perpendicular to the rotation direction of the fusing belt 50. However, a structure of the lubricant accommodating portion 95 is not limited thereto.

Referring to FIG. 7, the number of lubricant accommodating portions 95*a*, 95*b*, 95*c*, and 95*d* is plural, and the plurality of lubricant accommodating portions 95*a*, 95*b*, 95*c*, and 95*d* may be spaced apart from each other by a predetermined interval in the lengthwise direction. In this case, the impregnating members 100 may have shapes corresponding to those of the lubricant accommodating portions 95*a*, 95*b*, 95*c*, and 95*d* in the lengthwise direction. However, the shapes of the impregnating member 100 are not limited thereto. The impregnating members 100 may be continuously formed in the lengthwise direction to be longer than those of the lubricant accommodating portions 95*a*, 95*b*, 95*c*, and 95*d*.

Surfaces of the impregnating members 100 are disposed at openings of the lubricant accommodating portions 95*a*, 95*b*, 95*c*, and 95*d* to prevent lubricants 98 stored in the lubricant accommodating portions 95*a*, 95*b*, 95*c*, and 95*d* from being discharged through the openings in a short time. In addition, the impregnating members 100 may be formed of a porous material impregnating the lubricants 98 discharged from the openings. Separate grooves in which the impregnating members 100 may be seated may be formed in the vicinity of the openings of the lubricant accommodating portions 95*a*, 95*b*, 95*c*, and 95*d*.

Meanwhile, the number of lubricant accommodating portions 95*a*, 95*b*, 95*c*, and 95*d* is single, and the single lubricant accommodating portion may be formed along a width direction of the fusing belt 50. In this case, the lubricant 98 to be described below may have two or more kinds of different oil separations, and the numbers and positions of lubricant accommodating portions 95 and impregnating members 100 are not limited thereto as long as the lubricants 98 may be supplied between the fusing belt 50 and the nip forming member 80.

Referring to FIGS. 2 to 6, one surface of the impregnating member 100 is disposed toward the opening of the lubricant accommodating portion 95, and another surface of the impregnating member 100 is disposed to be in contact with the inner surface of the fusing belt 50. The impregnating member 100 impregnates or immerses the lubricant 98 supplied through the opening, and is in contact with the inner surface of the fusing belt 50 to deliver the impregnated lubricant to the inner surface of the fusing belt 50.

The impregnating member 100 may include felt or fabric. The felt is a product in which fibers are entangled by compression, and a nylon or polyamide fiber, a polyethylene terephthalate (PET) fiber, an aramid fiber, a polytetrafluoroethylene (PTFE) fiber, a preoxidized polyacrylonitrile (PAN) fibers, or a wool fiber may be used as an example of the fiber.

However, the definition of the felt and the material of the fiber are not limited thereto, and known felt and fiber may be used. The fabric is a product in which fibers are woven in a lattice structure, and a glass fiber or an aramid fiber may be used as an example of the fiber. However, the definition of the fabric and the material of the fiber are not limited thereto, and known fabric and fiber may be used. The impregnating member 100 may have a structure in which a plurality of layers are stacked, if necessary. A weight of the impregnating member 100 per unit area on the basis of a thickness of 1 mm may be 50 $g/m^2$ to 600 $g/m^2$.

The impregnating member 100 may impregnate some of components of the lubricant 98 stored in the lubricant accommodating portion 95. For example, in a case in which the lubricant 98 includes base oil and a thickener or a gelling agent to be described below, the impregnating member 100 may impregnate the base oil and may not impregnate the thickener or the gelling agent.

An outer surface of the impregnating member 100 in contact with the fusing belt 50 may have a curved or rounded shape. Therefore, a contact area between the impregnating member 100 and the fusing belt 50 may be maximized.

A contact portion of the nip forming member 80 in contact with the inner surface of the fusing belt 50 may include at least one of metal, felt, or fabric. An example of the metal may include nickel (Ni), stainless steel, copper (Cu), and alloys thereof. The felt is a product in which fibers are entangled by compression, and a nylon or polyamide fiber, a polyethylene terephthalate (PET) fiber, an aramid fiber, a polytetrafluoroethylene (PTFE) fiber, a preoxidized polyacrylonitrile (PAN) fibers, or a wool fiber may be used as an example of the fiber. However, the definition of the felt and the material of the fiber are not limited thereto, and known felt and fiber may be used. The fabric is a product in which fibers are woven in a lattice structure, and a glass fiber or an aramid fiber may be used as an example of the fiber. However, the definition of the fabric and the material of the fiber are not limited thereto, and known fabric and fiber may be used.

The lubricant 98 stored in the lubricant accommodating portion 95 may include two or more kinds of lubricants having different oil separations. Here, the oil separation refers to a phenomenon in which oil constituting grease is separated in a case in which the grease is stored for a long period of time or during use of the grease, and may also be called a synersis phenomenon. The synersis phenomenon may occur when maintenance of oil is unstable in a case in which a gel structure is not sufficient or oxidation of a capillary diameter is caused by fiber binding.

The lubricant 98 includes the base oil and the thickener or the gelling agent. The base oil may include a heat-resistant fluororesin not to be deformed at a high temperature. An example of the heat-resistant fluororesin may include perfluoro polyether (PFPE). However, the material of the base oil is not limited thereto, and may include other materials.

For example, the base oil may include at least one of mineral oil, ester oil, polyglycol oil, polyphenyl ether oil, silicone oil, or perfluoroalkyl ether oil. A viscosity index of the base oil can be 50 to 800. The viscosity index, which is an index indicating a change level of a viscosity depending on a temperature, indicates a change level of a viscosity depending on a temperature obtained by defining a viscosity index of paraffinic standard oil having a high viscosity index, for example, Pennsylvania oil as 100, defining a viscosity index of naphthenic standard oil having a low viscosity index, for example, Gulf Coast oil as 0, and comparing a viscosity index of any oil with these viscosity indices. The viscosity index is a well-known term, and a description for a detailed method of calculating the viscosity index will be omitted.

The lubricant 98 stored in the lubricant accommodating portion 95 may include the base oil and the thickener or the gelling agent as described above. The lubricant 98 stored in the lubricant accommodating portion 95 is discharged to the impregnating member 100 through the opening. The impregnating member 100 impregnates base oil that is separated from the thickener or the gelling agent or may not impregnate base oil that is not separated from the thickener or the gelling agent in the base oil.

The impregnating member 100 may be the felt or the fabric. At least a portion of the lubricant 98 may be separated into the thickener or the gelling agent and the base oil in a high-temperature environment, for example, an environment of 150 to 230° C. The base oil separated from the thickener or the gelling agent is impregnated in the impregnating member 100. Therefore, a weight ratio of the thickener or the gelling agent may become significantly smaller in the lubricant 98 impregnated in the impregnating member 100 than in the lubricant 98 stored in the lubricant accommodating portion 95.

The lubricant 98 delivered to the inner surface of the fusing belt 50 moves between the fusing belt 50 and the nip forming member 80 by rotation of the fusing belt 50. Because the lubricant 98 in which the weight ratio of the thickener or the gelling agent becomes small moves between the nip forming member 80 and the fusing belt 50, even though the high pressure acts between the nip forming member 80 and the fusing belt 50, a friction problem due to the thickener or the gelling agent may be prevented.

In a case in which the lubricant 98 supplied between the nip forming member 80 and the fusing belt 50 includes a predetermined ratio (for example, 30% of an entire weight of the lubricant 98) or more of thickener or gelling agent unlike the disclosure, the lubricant 98 may be separated into the base oil and the thickener or the gelling agent by the high pressure and high temperature acting between the nip forming member 80 and the fusing belt 50, and only the base oil in a liquid state may be leaked out or vaporized. Therefore, only the thickener or the gelling agent remains between the nip forming member 80 and the fusing belt 50, which may act as a cause of an increase in friction.

In the embodiment of the disclosure, the lubricant 98 supplied between the nip forming member 80 and the fusing belt 50 hardly includes the thickener or the gelling agent. Therefore, even though the high temperature and the high pressure are applied between the nip forming member 80 and the fusing belt 50, a phenomenon in which only the thickener or the gelling agent remains between the nip forming member 80 and the fusing belt 50 may be prevented.

A predetermined ratio of thickener or gelling agent is included in the lubricant 98 stored in the lubricant accommodating portion 95, such that an amount of the lubricant 98 discharged from the lubricant accommodating portion 95 may be controlled.

In a case in which the impregnating member 100 is a member impregnating only the base oil of the lubricant 98, an amount of thickener or gelling agent impregnated in the impregnating member 100 may be changed depending on a ratio of the thickener or gelling agent included in the lubricant 98 stored in the lubricant accommodating portion 95.

Figure 8:
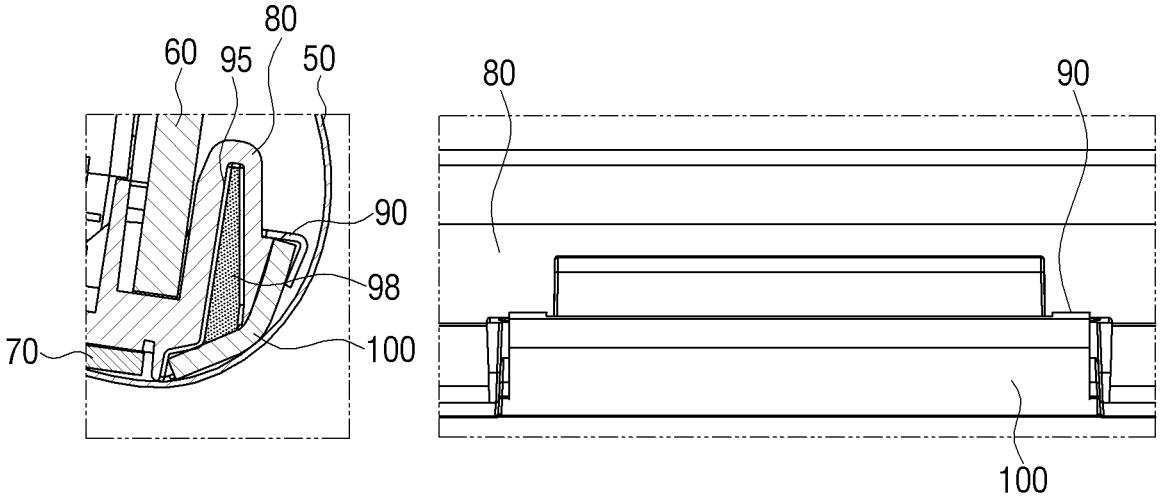
FIGS. 8 to 11 are views for describing various modified examples of a fixing member according to the embodiment of the disclosure.

FIGS. 8 to 11 are views for describing various modified examples of a fixing member according to the embodiment of the disclosure. Referring to FIG. 8, the fusing device 10 according to the embodiment of the disclosure further includes the fixing member 90 to prevent the impregnating member 100 from being separated from the nip forming member 80 due to a continuous contact external force of the fusing belt 50. The fixing member 90 may have a clip shape having an elastic force, and may include a separate fastener so that at least a portion of an outer side of the impregnating member 100 is mounted in the nip forming member 80.

In this case, a support groove (not illustrated) in which the fixing member 90 is provided in the nip forming member 80 so that an upper end of the fixing member 90 is stably supported by the nip forming member 80, such that the fixing member 90 may press the impregnating member 100 in a state in which one end portion of the fixing member 90 is stably supported in the support groove.

Figure 9:
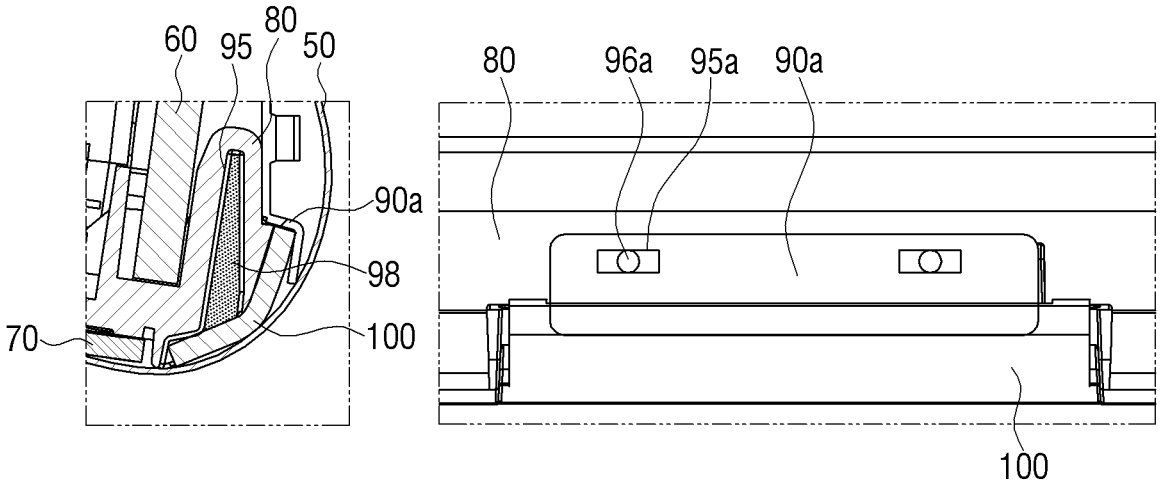

Referring to FIG. 9, a fixing member 90*a* may have a lancing structure so that the impregnating member 100 is mounted on the nip forming member 80. Here, the lancing structure is a structure in which lancing holes 95*a* are formed in the fixing member 90*a*, and coupling brackets 96*a* are fitted into the lancing holes 95*a*, such that the impregnating member 100 may be mounted on the nip forming member 80.

Figure 10:
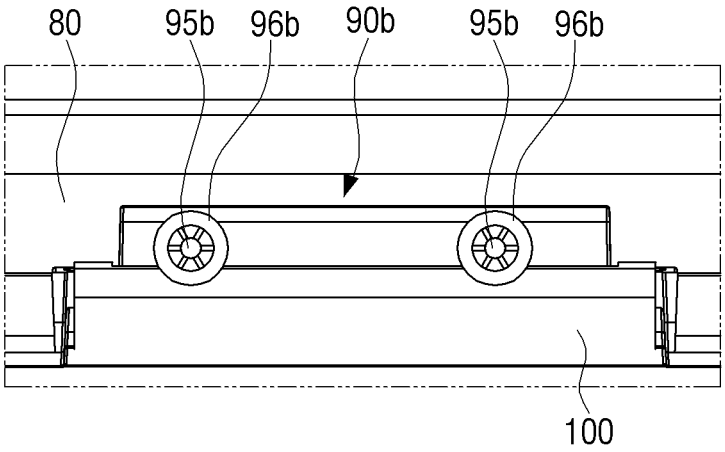
Figure 11:
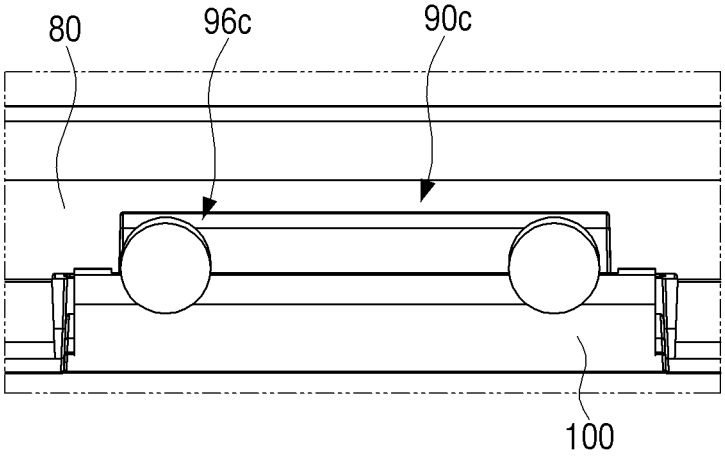

As illustrated in FIGS. 10 and 11, it is possible to separate the impregnating member 100 from the nip forming member 80 using separate stop rings (cs-rings) 96*b* or fasteners 96*c*.

As illustrated in FIG. 10, a fixing member 90*b* includes protrusions 95*b* formed on one side of the nip forming member 80 and the stop rings 96*b* pushed toward and fitted onto the protrusions 95*b* to fix the protrusions 95*b*. The stop ring 96*b* may be a mechanical element forcibly pushed toward and fitted onto a counterpart without having a shaft to fix the counterpart. Meanwhile, the protrusion 95*b* may be formed integrally with the nip forming member 80 or may be formed separately from the nip forming member and be adhered to the nip forming member 80.

In addition, as illustrated in FIG. 11, a fixing member 90*c* includes separate fasteners 96*c*, and the fasteners 96*c* is fastened to screw holes (not illustrated) formed on one side of the nip forming member 80. The impregnating member 100 is fixed to the nip forming member 80 by coupling the fasteners 96*c* (for example, bolts) into the screw holes in a state in which the impregnating member 100 is interposed.

Figure 12A:
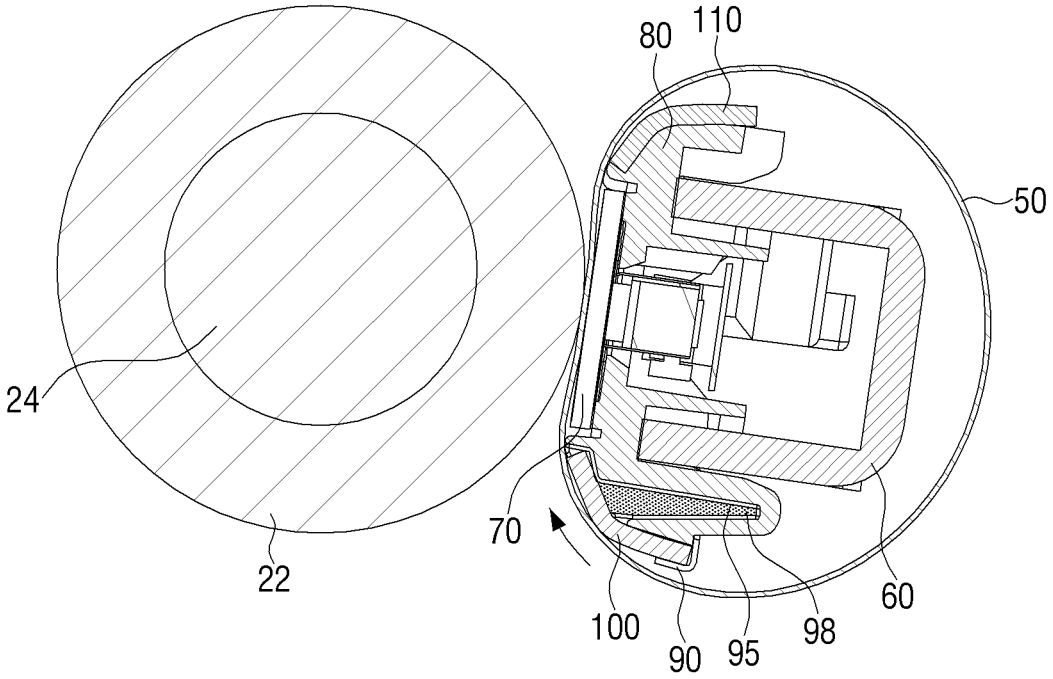
FIGS. 12A and 12B are cross-sectional views illustrating a fusing device according to another embodiment of the disclosure.
Figure 12B:
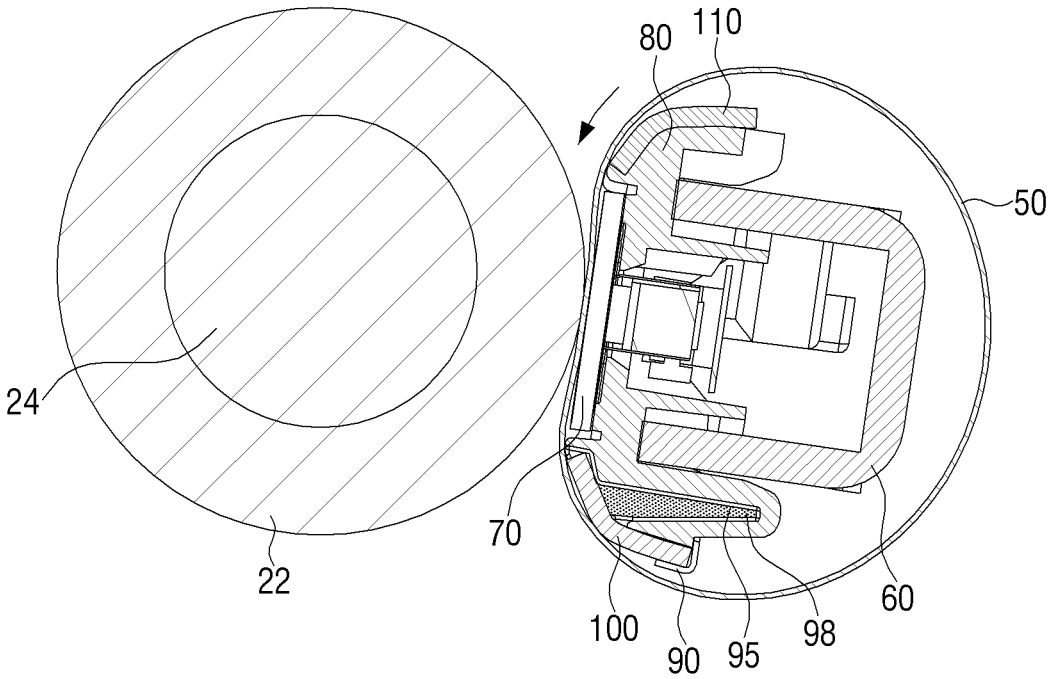

FIG. 12A is a cross-sectional view illustrating a fusing device according to another embodiment of the disclosure, and FIG. 12B is a cross-sectional view for describing an operation state of the fusing device according to another embodiment of the disclosure. Hereinafter, contents different from those of the fusing device according to the embodiment of the disclosure described with reference to FIGS. 2 to 8 will be mainly described, and contents for which a description is omitted may be replaced by the abovementioned contents.

Referring to FIGS. 12A and 12B, a fusing device 10 may include a fusing roller 20 and a nip forming member 80 that are disposed to face each other to form a fusing nip N through which a recording medium S passes, a fusing belt 50 circumscribed to the fusing roller 20 to be driven and rotated by the fusing roller 20, a heater 70 heating the fusing belt 50, lubricant supplying units 95 and 100 supplying a lubricant 98 to an inner surface of the fusing belt 50, and a fixing member 90 fixing an impregnating member 100, 110 provided in the lubricant supplying units 95 and 100 to the nip forming member 80.

The impregnating member 100, 110 includes a first impregnating member 100 disposed at a rear of the nip forming member 80 on the basis of a rotation direction of the fusing belt 50 and a second impregnating member 110 disposed at a front of the nip forming member 80 on the basis of the rotation direction of the fusing belt 50.

In a case in which the fusing roller rotates in a forward direction as illustrated in FIG. 12A, the lubricant 98 supplied to the inner surface of the fusing belt 50 may be impregnated in the second impregnating member 110 positioned at the front of the nip forming member 80. Then, in a case in which the fusing roller 20 rotates in a reverse direction during a period in which printing is not performed as illustrated in FIG. 12B, the lubricant 98 contained in the second impregnating member 110 may be supplied again to the inner surface of the fusing belt 50.

Here, each of the first impregnating member 100 and the second impregnating member 110 may be formed of a porous material including felt and fabric.

Meanwhile, it has been described hereinabove that the impregnating members 100 and 110 are disposed at the rear and the front of the nip forming member 80, respectively, but a plurality of lubricant supplying units 95 and 100 may also be provided at the rear and the front of the nip forming member 80, respectively.

Figure 13:
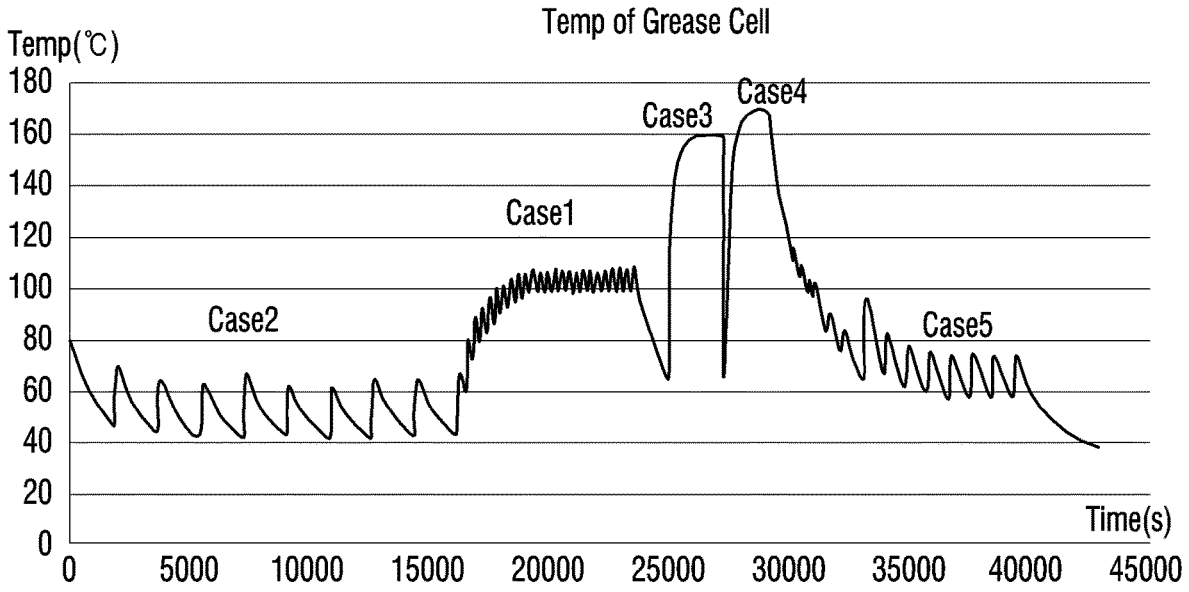
FIG. 13 is a graph for describing a temperature change depending on a printing condition.

FIG. 13 is a graph for describing a temperature change depending on a printing condition. The graph of FIG. 13 illustrates a result of an experiment performed so that the lubricant 98 may correspond to several temperature environments depending on a printing condition of a user. In Case 1, as a result of repeatedly performing for 120 minutes a process of printing images on three recording media and leaving the image forming apparatus as it is for five minutes, a temperature of the lubricant 98 was about 100° C. In Case 2, as a result of repeatedly performing for 240 minutes a process of printing images on three recording media and leaving the image forming apparatus as it is for thirty minutes, a temperature of the lubricant 98 was about 60° C. In addition, in Case 3, as a result of repeatedly performing for thirty minutes a process of printing images on three recording media and leaving the image forming apparatus as it is for ten seconds, a temperature of the lubricant 98 was about 155° C., and in Case 4, as a result of continuously printing images for thirty minutes, a temperature of the lubricant 98 was about 170° C. In addition, in Case 5, as a result of repeatedly performing for 120 minutes a process of printing images on three recording media and leaving the image forming apparatus as it is for fifteen minutes, a temperature of the lubricant 98 was about 72° C.

In the lubricant 98 according to the embodiment of the disclosure, a weight ratio of the thickener or the gelling agent may exceed 0% of an entire weight of the lubricant 98 and be equal to or less than 20% of the entire weight of the lubricant 98, in consideration of these experiment results. Here, weights of the lubricant 98 and the thickener or the gelling agent may be measured before the lubricant 98 is discharged to the impregnating member 100, and the entire weight of the lubricant 98 may be a value obtained by adding up weights of the base oil and the thickener or the gelling agent.

In a case in which the weight ratio of the thickener or the gelling agent is 0% of the entire weight of the lubricant 98, that is, in a case in which the lubricant 98 does not include the thickener or the gelling agent, the lubricant 98 stored in the lubricant accommodating portion 95 is supplied to the impregnating member 100 within a short time by the high-temperature and high-pressure environment. Because it is not limited by the thickener or the gelling agent that the lubricant 98 that does not include the thickener or the gelling agent is supplied to the impregnating member 100, the lubricant 98 is in a state in which the entirety thereof may be supplied to the impregnating member 100. Therefore, the lubricant 98 stored in the lubricant accommodating portion 95 may be discharged within a short time.

However, in a case in which the weight ratio of the thickener or the gelling agent exceeds 0% of the entire weight of the lubricant 98, the supply of a portion of the lubricant 98 to the impregnating member 100 is limited by the thickener or the gelling agent. In a predetermined temperature condition, for example, a condition of 150 to 230° C., a portion of the base oil is separated from the thickener or the gelling agent, but the other portion of the base oil is not separated from the thickener or the gelling agent. Therefore, only the base oil separated from the thickener or the gelling agent is supplied to the impregnating member 100, and the base oil that is not separated from the thickener or the gelling agent is not supplied to the impregnating member 100. Therefore, the lubricant 98 stored in the lubricant accommodating portion 95 is not supplied to the impregnating member 100 within the short time, and is slowly supplied to the impregnating member 100.

However, in a case in which the weight ratio of the thickener or the gelling agent exceeds 20% of the entire weight of the lubricant 98, the base oil and the thickener or the gelling agent are hardly separated from each other. Therefore, the lubricant 98 supplied to the impregnating member 100 is significantly reduced. In this case, it becomes difficult for the impregnating member 100 to perform a function of supplying the lubricant 98 to the inner surface of the fusing belt 50.

Meanwhile, a state of the lubricant 98 including the base oil and the thickener or the gelling agent may be changed depending on a temperature condition. For example, in a case in which a temperature of the lubricant 98 satisfies a predetermined temperature, the base oil and the thickener or the gelling agent may be separated from each other. The predetermined temperature may be about 150 to 230° C., which is an internal temperature of the lubricant accommodating portion 95 during a period in which the fusion is performed. In a case in which the temperature of the lubricant 98 does not satisfy the predetermined temperature, for example, in a case in which the temperature of the lubricant 98 is less than about 150° C., the base oil and the thickener or the gelling agent are not separated from each other, such that the lubricant 98 may be maintained in a semi-solid state. Therefore, it is possible to prevent the lubricant 98 in the lubricant accommodating portion 95 from being discharged to the impregnating member 100 during the period in which the fusion is not performed.

In addition, according to the embodiment of the disclosure, it is possible to prevent the lubricant 98 from being leaked to the outside in a short time in the high-temperature and high-pressure environment. Further, it is possible to prevent meandering of and damage to the fusing belt 50 to significantly improve lifespans of the fusing device 10 and the image forming apparatus 1.

Although the diverse embodiments of the disclosure have been individually described hereinabove, the respective embodiments are not necessarily implemented singly, and may also be implemented so that configurations and operations thereof are combined with those of one or more other embodiments.

In addition, specific embodiments have been illustrated and described hereinabove. However, the disclosure is not limited to only the abovementioned embodiments, but may be variously modified by those skilled in the art to which the disclosure pertains without departing from the scope and spirit of the disclosure stated in the claims.

What is claimed is:

1. A fusing device comprising:

a fusing roller;

a fusing belt circumscribed to the fusing roller to be driven and rotated by the fusing roller;

a nip forming member inscribed to the fusing belt to form a nip at a contact portion with the fusing roller;

a lubricant supplying unit to include, a lubricant accommodating portion to store a lubricant to discharge the lubricant through an opening of the lubricant accommodating portion, the lubricant accommodating portion provided at one side of the nip forming member, and an impregnating member disposed towards the opening to impregnate the lubricant discharged from the lubricant accommodating portion and to supply the lubricant to an inner surface of the fusing belt; and a fixing member having a clip shape to mount a portion of the impregnating member on the nip forming member and to provide an elastic force to press an outer side of the impregnating member to cause the outer side of the impregnating member be mounted on the nip forming member.

2. The fusing device as claimed in claim 1, wherein the lubricant supplying unit is positioned at an upstream on basis of the contact portion at which the nip is formed.

3. The fusing device as claimed in claim 2, wherein the impregnating member is inscribed to the fusing belt.

4. The fusing device as claimed in claim 2, wherein the lubricant supplying unit is plural lubricant supplying units, and respective lubricant supplying units are disposed at an interval along a width direction of the fusing belt.

5. The fusing device as claimed in claim 1, wherein the impregnating member includes:

a first impregnating member disposed at an upstream on basis of the contact portion at which the nip is formed; and a second impregnating member disposed at a downstream on basis of the contact portion at which the nip is formed and absorbing the lubricant supplied from the first impregnating member.

6. The fusing device as claimed in claim 5, wherein the fusing roller is rotatable in a forward direction and a reverse direction.

7. The fusing device as claimed in claim 5, wherein the first impregnating member and the second impregnating member are positioned to be symmetrical to each other on basis of the contact portion at which the nip is formed.

8. The fusing device as claimed in claim 5, wherein one surface of each of the first impregnating member and the second impregnating member in contact with the fusing belt has a curved shape.

9. The fusing device as claimed in claim 1, wherein the lubricant accommodating portion has a shape in which a cross-sectional area of the accommodating portion is increased toward the opening.

10. The fusing device as claimed in claim 9, wherein the opening is provided to face the fusing roller, and the impregnating member divides the opening from outside.

11. The fusing device as claimed in claim 1, wherein the fixing member includes a fastener so that the portion of the impregnating member is mounted on the nip forming member.

12. The fusing device as claimed in claim 11, wherein the fixing fastener is inserted and fastened into a screw hole formed in the nip forming member.

13. The fusing device as claimed in claim 1, wherein the fixing member is wedged and coupled to a hole formed in the nip forming member.

14. The fusing device as claimed in claim 1, wherein the fixing member includes a coupling ring fitted and fixed into a protrusion formed on one side of the nip forming member and supported from the protrusion.

15. The fusing device as claimed in claim 1, wherein the lubricant includes two or more kinds of lubricants having different oil separations.

16. The fusing device as claimed in claim 1, wherein the impregnating member is formed of a porous material delivering the lubricant to the fusing belt.

17. A fusing device comprising:

a fusing roller;

a fusing belt circumscribed to the fusing roller to be driven and rotated by the fusing roller;

a nip forming member inscribed to the fusing belt to form a nip at a contact portion with the fusing roller; and lubricant supplying units fixed to the nip forming member, and positioned, respectively, at a front and a rear of the nip forming member on basis of a rotation direction of the fusing belt, to supply a lubricant to an inner surface of the fusing belt.

18. The fusing device as claimed in claim 17, wherein a lubricant supplying unit among the lubricant supplying units includes, a lubricant accommodating portion to store the lubricant, and an impregnating member to impregnate the lubricant from the lubricant accommodating portion and supply the lubricant to the inner surface of the fusing belt, and the fusing device further comprising a fixing member supporting each of one end portion and other end portion of the impregnating member to the nip forming member to prevent the impregnating member from being separated from the nip forming member.

19. An image forming apparatus, comprising:

a photoreceptor on which an electrostatic latent image is formed;

a developing unit configured to supply a toner to the electrostatic latent image to form a visible toner image on a recording medium; and the fusing device as claimed in claim 17 to apply heat and pressure to the toner image transferred to the recording medium to fuse the toner image.

* * * * *